US006081960A

United States Patent [19]

Shook et al.

[11] Patent Number: 6,081,960

[45] Date of Patent: Jul. 4, 2000

[54] ROTATING FLUID JET CLEANING SYSTEM FOR VERTICAL WALLS

[75] Inventors: Forrest A. Shook; Matthew O. Herhold, both of Fenton, Mich.

[73] Assignee: NLB Corporation, Wixom, Mich.

[21] Appl. No.: 09/193,668

[22] Filed: Nov. 17, 1998

[51] Int. Cl.[7] ..... B08B 5/04

[52] U.S. Cl. ..... 15/322

[58] Field of Search ..... 15/302, 322, 345

[56] References Cited

U.S. PATENT DOCUMENTS

| | | | |
|---|---|---|---|
| 1,821,715 | 9/1931 | Kuchinsky | 15/322 |
| 2,815,919 | 12/1957 | Pribil . | |
| 3,495,358 | 2/1970 | Riedi . | |
| 3,892,287 | 7/1975 | Bennett . | |
| 3,958,652 | 5/1976 | Urakami et al. . | |
| 4,095,378 | 6/1978 | Urakami . | |
| 4,107,816 | 8/1978 | Matthews | 15/322 X |
| 4,191,590 | 3/1980 | Sundheim | 15/322 X |
| 4,193,469 | 3/1980 | Graf . | |
| 4,377,018 | 3/1983 | Cain | 15/322 |
| 4,688,289 | 8/1987 | Urakami . | |
| 4,809,383 | 3/1989 | Urakami . | |
| 4,926,957 | 5/1990 | Urakami . | |
| 4,934,475 | 6/1990 | Urakami . | |
| 4,997,052 | 3/1991 | Urakami . | |
| 5,007,210 | 4/1991 | Urakami . | |
| 5,014,803 | 5/1991 | Urakami . | |
| 5,028,004 | 7/1991 | Hammelmann . | |
| 5,048,445 | 9/1991 | Lever et al. . | |
| 5,321,869 | 6/1994 | Kaempf . | |
| 5,628,271 | 5/1997 | McGuire . | |
| 5,826,298 | 10/1998 | Rohrbacher et al. | 15/322 X |
| 5,970,574 | 10/1999 | Thrash | 15/345 X |

FOREIGN PATENT DOCUMENTS

| | | |
|---|---|---|
| 6226173 | 4/1987 | Japan . |

*Primary Examiner*—Chris K. Moore
*Attorney, Agent, or Firm*—Howard & Howard

[57] ABSTRACT

An improved system for cleaning vertical walls includes a vacuum source to adhere the system to the vertical wall. The vacuum source removes fluid and removed material from the wall, and also adheres the system to the wall. A rotating fluid jet is positioned radially inwardly of the vacuum source and impinges high pressurized fluid off of the surface to be cleaned to remove material. In a preferred embodiment, a central portion mounts both the fluid source and the vacuum source. A base portion mounts motors for driving the system along the wall. The base portion rotates relative to the central portion such that the central portion does not move as the base portion turns on the wall to drive the system along the wall. In a further feature, an additional air flow system is provided to provide supplemental air flow to assist the vacuum when moving the fluid and removed material.

18 Claims, 5 Drawing Sheets

ROTATING FLUID JET CLEANING SYSTEM FOR VERTICAL WALLS

BACKGROUND OF THE INVENTION

This invention relates to a system which impinges a rotating water jet on a wall, and which adheres to the wall due to a vacuum force.

In the prior art, vertical walls such as are typically found in ship hulls are cleaned by systems which move along the walls and apply treatment to the surface. In particular, the systems are used to remove paint.

In one known type of system, a vacuum force adheres the moving system to the wall. The walls may be rather high, and the vacuum sources are often remote from the system. In the past, the system has moved and turned along the wall, and the connection to the vacuum source has sometimes become twisted, or misaligned, between the source and the moving system.

In such systems, it is difficult to ensure the system maintains contact on the surface to be cleaned while it moves. In the past the vacuum force holding the system on the wall may sometimes be lost due to inadequate sealing.

In addition, the proposed systems to date have not adequately cleaned the wall while still providing sufficient holding force.

SUMMARY OF THE INVENTION

The present invention is directed to a system which applies a rotating fluid jet onto a surface to be cleaned, and also provides a vacuum to remove fluid from the rotating fluid jet along with material (typically paint) removed from the surface to be cleaned. In a preferred embodiment both the fluid jet and the vacuum source are mounted on a central portion which remains stationary relative to a moving base. The moving base supports the central portion, but is capable of turning relative to the central portion without turning the central portion.

Thus, when the system is moved along a wall, the base and the entire system can change directions without changing the orientation of the central portion. The fluid lines leading to the vacuum source, and the rotating jets, etc. do not change orientation. In this way, the present invention thus ensures that the orientation will be predictable and will not become twisted.

In other features of this invention, the vacuum source is provided between two generally cylindrical walls. An inner cylindrical wall surrounds the rotating fluid jet, and a second cylindrical wall is spaced outwardly of the first cylindrical wall. A vacuum chamber is defined between the two walls. A curved seal is positioned radially outwardly of the second cylindrical wall and defines the end of the vacuum chamber. A source of additional fluid pressure is provided within the vacuum chamber. Preferably, the additional source is provided by a valve extending through the second cylindrical wall to communicate with the outside atmosphere. As long as the vacuum source is sufficiently low, the valve opens allowing air flow into the vacuum chamber, through a hole in an end wall. The vacuum chamber is preferably defined by a slanted end wall which is spaced toward the surface to be cleaned at the location of the additional fluid flow, and extend away from the surface to be cleaned in both circumferential directions from the hole. In this way, air is brought into the vacuum chamber and along the slanted wall to assist the flow of the fluid and removed surface materials to the vacuum source. This improves the ability to clean and remove material from the surface to be cleaned.

A preferred embodiment of this invention includes many other features. By studying the following drawings and specification one will identify many other beneficial features.

DETAILED DESCRIPTION OF A PREFERRED EMBODIMENT

Figure 1:
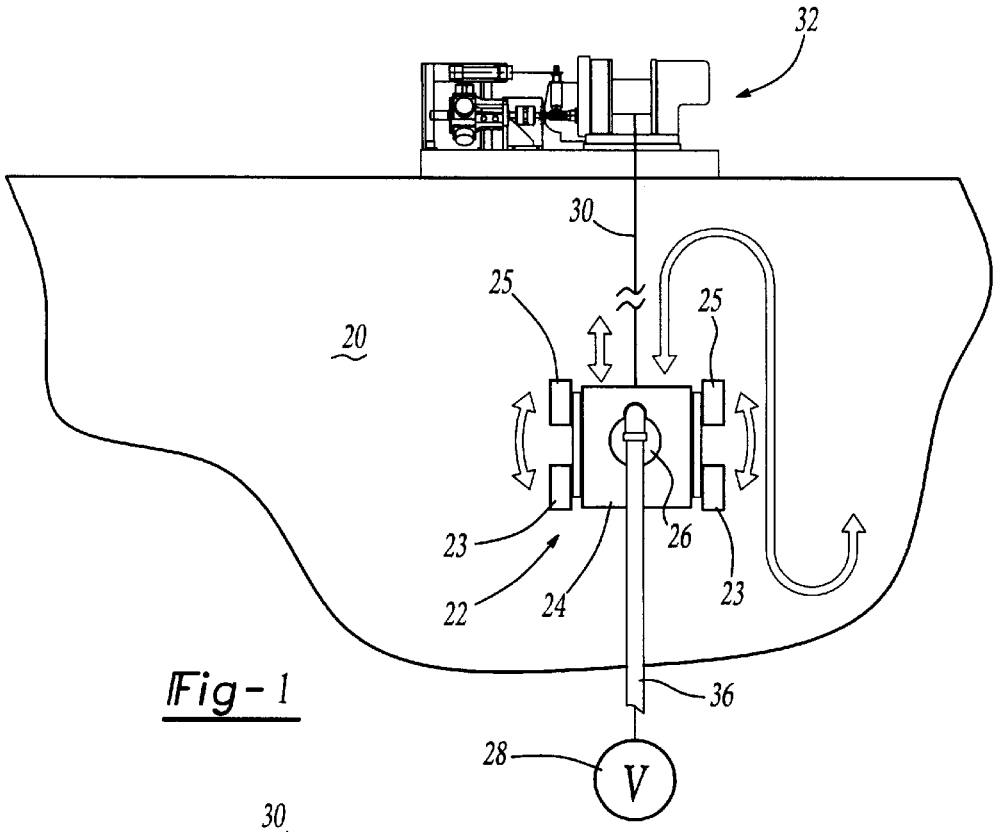
FIG. 1 is a schematic view of the system according to the present invention.

FIG. 1 shows a system cleaning a wall 20 such as a ship's hull. The cleaning system 22 moves with rear wheels 23 on each side of a base 24. Forward wheels 25 are spaced on each side of the base 24 also. A central portion 26 is defined within the base 24. A vacuum source 28 communicates through a vacuum line 36 to the central portion 26, as will be explained in greater detail below. The vacuum source 28 is preferably capable of generating a very high vacuum level within central portion 26. A cable 30 supports the system 22 and is held by a cable assembly 32, explained in greater detail below.

Figure 2:
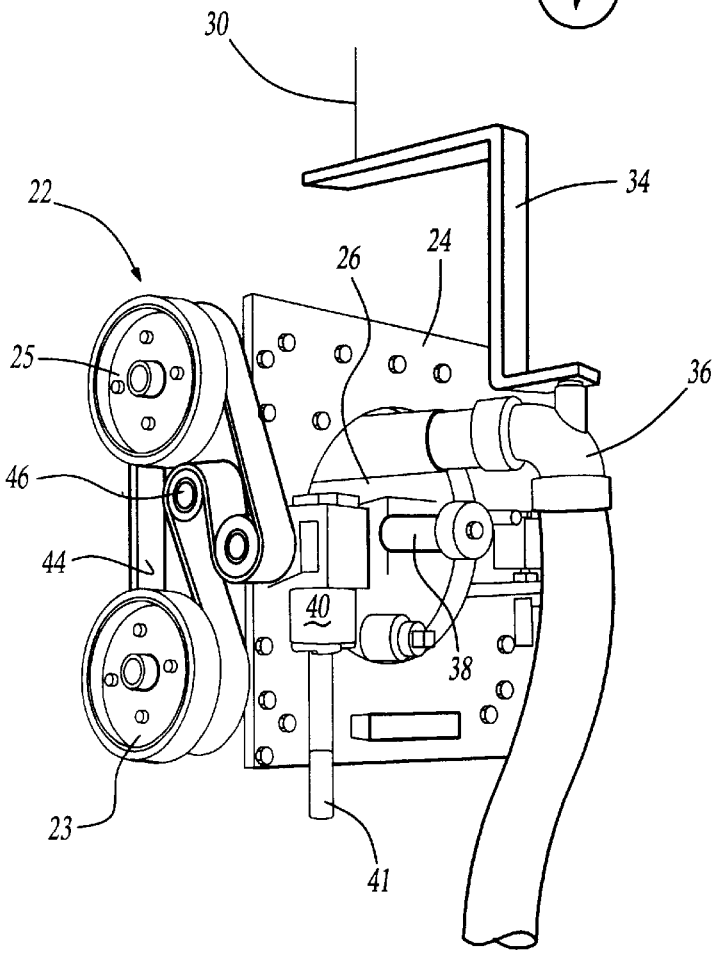
FIG. 2 is a perspective view of the cleaning system.

As shown in FIG. 2, the system 22 incorporates a cable bracket 34 fixed to the vacuum tube 36. A fluid source 38 provides pressurized fluid, as will be explained below. Further motors 40 drive the wheels 23, 25 on each side through a system of belts 44 and rollers 46. The motors 38 and 40 may be rotary pneumatic motors, and are preferably supplied with pressurized air such as through line 41. The present invention thus provides a pair of motors, with one motor associated with wheels on each side of the base 24. In this way, the wheels can be driven, with one being reversed and the other being driven forward, to turn the base 24 about a central axis.

Figure 3:
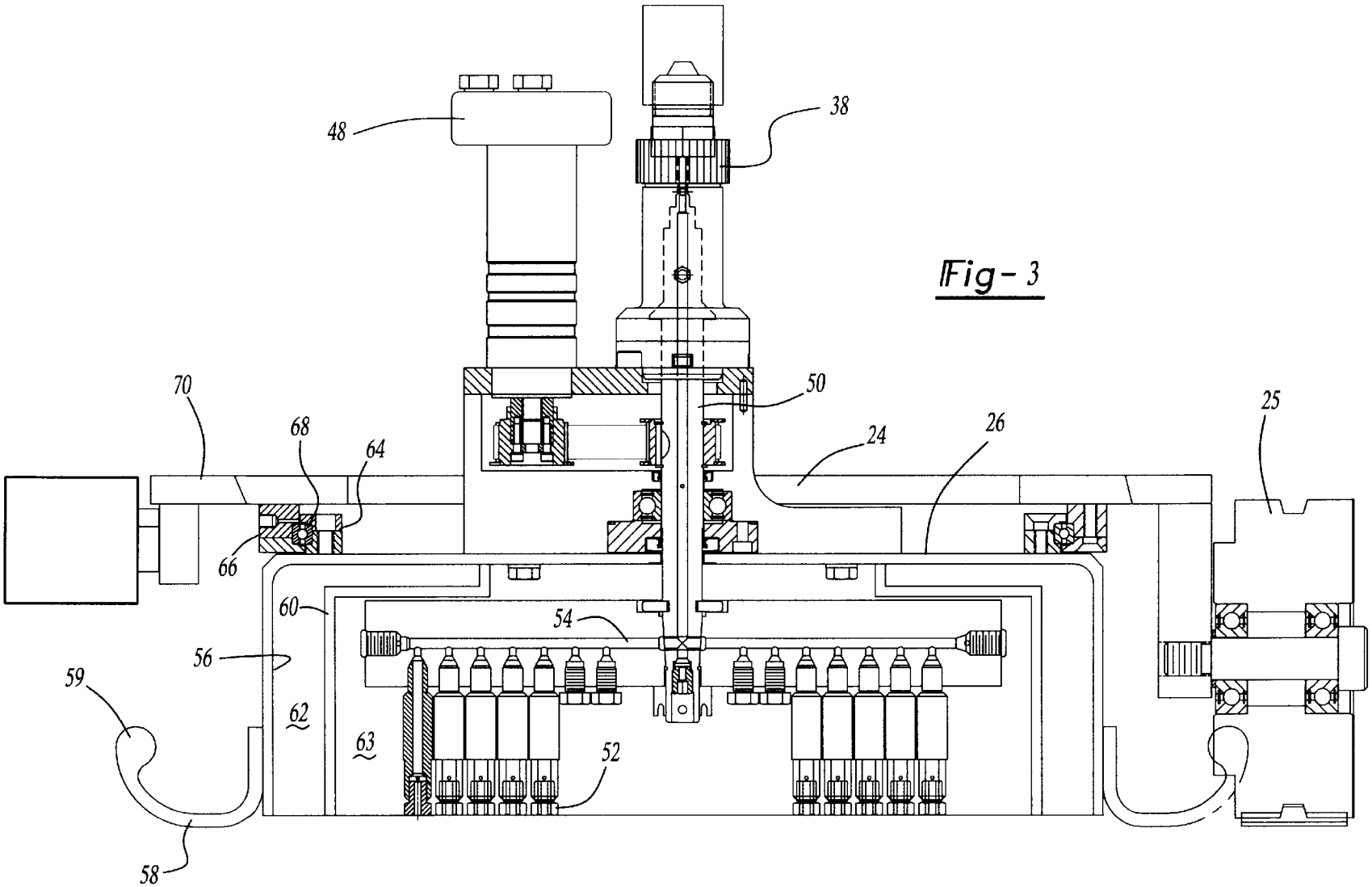
FIG. 3 is a cross-sectional view through the system.

As shown in FIG. 3, the central portion 26 is mounted for relative rotation on the base 24. As can be understood from FIG. 3, the motors 48 for driving the rotating shaft 50 and the fluid supply source 38 are mounted on the central portion 26. Fluid nozzles 52 face the surface to be cleaned. Ports 54 supply pressurized fluid from source 38 to the nozzles 52.

An outer wall 56 is associated with a radially outer seal 58. As shown, radially outer seal 58 curves away from the surface to be cleaned to an outer lip 59. This generally unshaped seal structure limits the tendency of the seal to curve under itself when it is held against the surface to be cleaned.

An inner wall 60 defines a vacuum chamber 62 between the walls 56 and 60. As can be understood, an inner cleaning chamber 63 is positioned radially inwardly of the wall 60. Fluid is directed from the nozzles 52 onto the surface to be cleaned. The fluid jets remove surface material such as paint from the wall. That paint and fluid is then drawn into the vacuum chamber 62, as will be explained below.

A bearing portion 64 is formed on the central portion 26 and a second bearing portion 66 is associated with a table 70 on the base 24. A series of central bearings 68 are placed between the bearing portion 64 and 66. When the wheels 23 and 25 are driven to turn the base 24 and table 70, the central portion 26 does not turn. This assists the seal 58 in remaining against the surface to be cleaned, and not moving away from the surface to be cleaned when the base 24 turns. This further provides other assistance with regard to the direction of the fluid lines, as will be explained below.

Figure 4:
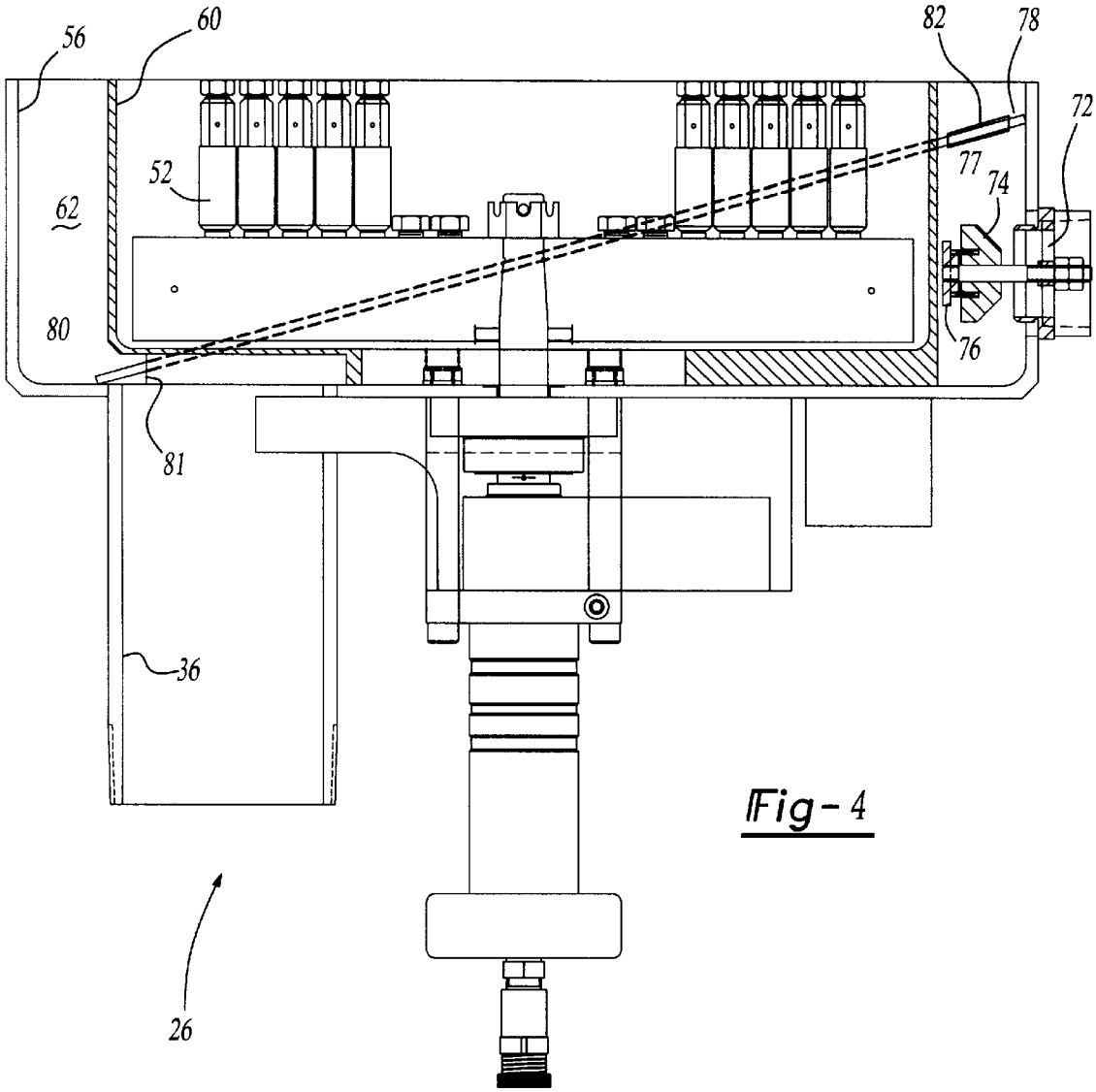
FIG. 4 is a cross-sectional view through a portion of the system.

As shown in FIG. 4, within the central portion 26, the system includes an opening 72 to atmosphere through the outer wall 56. A valve 74 is spring-biased 76 to selectively close the opening 72. Opening 72 extends into a space 77 leading to an end wall 78. An opening 82 extends through the wall 78. The wall is ramped between the end 78 associated with the opening 82, and to an opposed end 80 spaced further from the surface to be cleaned, as can be appreciated from this figure. An opening 81 extends from the space 80 to the vacuum source 36.

When the vacuum is applied, the fluid and removed material move into the area beneath the end wall. If the vacuum is sufficient, supplemental flows in through the opening 72, opening 82, and into the area 78. The supplemental air draws the fluid and the removed material along the entire circumference of the space 62 to the area 80. This is assisted by the ramped surface of the end wall between ends 78 and 80.

Figure 5:
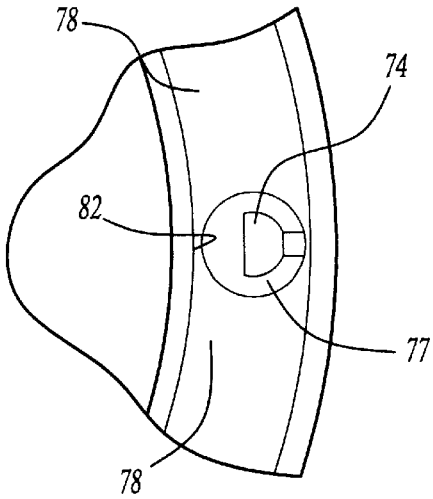
FIG. 5 is an end view along one portion of the system.

It should be understood that the ramp extends in both circumferential directions from the central opening 82. This can be appreciated from FIG. 5 which shows the space 77 extending through the opening 82. The closer areas 78 are shown on both circumferential sides of the opening 82, and both extend to a single spaced area 80 associated with the opening 81, which is spaced further from the wall to be cleaned.

Figure 6A:
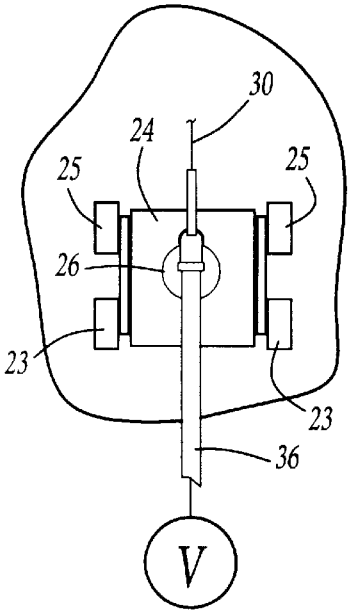
FIG. 6A shows the system in one orientation.
Figure 6B:
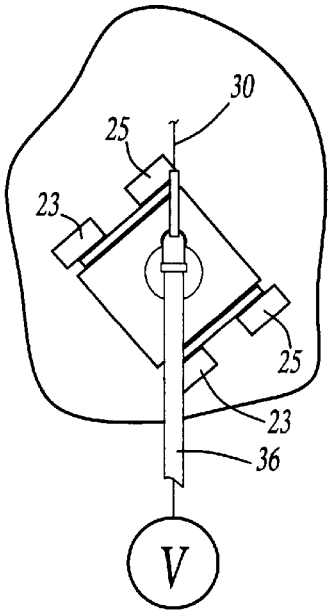
FIG. 6B shows the system turned slightly from the first orientation.
Figure 6C:
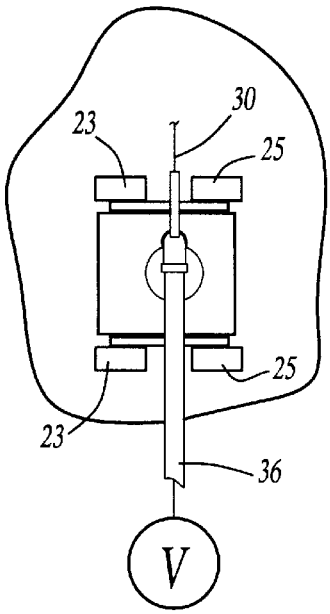
FIG. 6C shows the system turned to yet another orientation.

Due to the ability of central portion 26 to rotate relative to portion 24, the system can rotate between several positions as shown in FIGS. 6A to 6C. In each of these positions the vacuum tube 36 maintains an orientation as does the cable 30. This assists in simplifying the operation of the system, and eliminates twisting or kinking in either the vacuum line 36 or the cable 30. Further, the seal does not turn, this also assists in maintaining an adequate seal and holding force.

Figure 7:
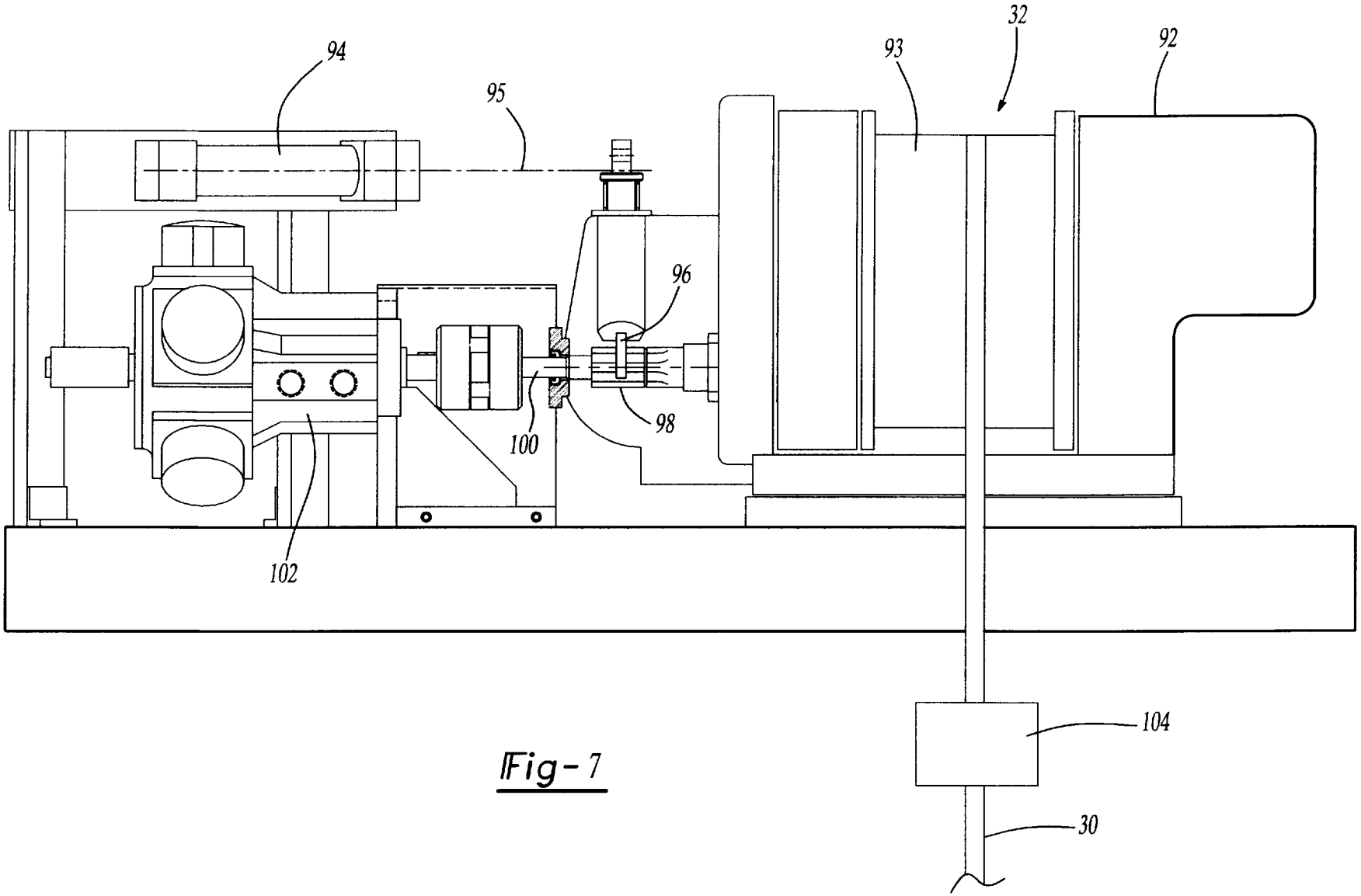
FIG. 7 shows another aspect of the present invention.

FIG. 7 shows the system 32 for maintaining the cable 30. As shown, a first motor 92 selectively drives a coil 93 of the cable 30 upwardly and downwardly. This is to perform movement of the system 22 when it is initially being adhered to the surface 20, and when it is being lowered back to the ground.

During operation, a secondary motor system including a piston 94 actuates a lever 95 to move a yoke 96. Yoke 96 selectively connects a shaft 98 associated with the coil 93 to a shaft 100 associated with a secondary motor 102. Secondary motor 102 may be an air motor while primary motor 92 may be an electric motor. In this way, a secondary motor is utilized when the primary motor is disconnected. At that time, the secondary motor will provide a smaller force picking up slack in the cable 30 as the system moves about the surface 20 to be cleaned. This occurs when the yoke 96 has been moved to engage the shafts 98 and 100. In another feature, a safety brake 104 is incorporated between the system 32 and the system 22. The brake 104 is actuated if the cable 30 moves at too great a speed to lock the cable. The structure of the brake 104 may be as known in the art. By locking the cable 30 if it moves at too great of a speed, the brake 104 ensures that the system is unlikely to fall should the vacuum break, but instead it will be caught by the brake 104 and held until an operator can evaluate what has happened with the system.

A preferred embodiment of this invention has been disclosed, however, a worker of ordinary skill in this art will recognize that certain modifications come within the scope of this invention. For that reason, the following claims should be studied to determine the true scope and content of this invention.

What is claimed is:

1. A system for cleaning a planar surface comprising:

a central rotating fluid jet system for supplying a high pressure fluid against the surface to be cleaned;

a vacuum chamber associated with a vacuum source, said central rotating fluid jet system and said vacuum chamber both being mounted on a central body portion; and a base portion provided with a drive motor for driving said base portion along a surface to be cleaned, said central rotating fluid jet system being mounted for relative rotation on said base portion, and for movement with said base portion.

2. A system as recited in claim 1, wherein said base portion carries a wheel driven by said drive motor to move said base portion along the surface.

3. A system as recited in claim 2, wherein said wheels are driven by a belt and roller system.

4. A system as recited in claim 3, wherein an air motor drives said belt.

5. A system as recited in claim 1, wherein said central rotating jet includes a plurality of fluid nozzles spaced about a rotating axis.

6. A system as recited in claim 5, wherein there is a motor to drive said rotating fluid jet system, said motor being mounted on said central body portion.

7. A system as recited in claim 1, wherein a first wall surrounds said central rotating jet and a second wall is spaced radially outwardly of said first wall, said vacuum chamber defined between said first and second walls.

8. A system as recited in claim 7, wherein said vacuum chamber is defined by a slanted wall which modifies a cross-sectional area defined in a plane extending radially relative to an axis of rotation of said rotating fluid jet of said vacuum chamber between spaced circumferential locations.

9. A system as recited in claim 8, wherein an additional fluid flow line is associated with a portion of said vacuum chamber having an upper extent spaced more toward the surface to be cleaned than circumferentially spaced portions, said additional flow line being provided by a selectively open valve.

10. A system as recited in claim 9, wherein said vacuum source removes fluid from said vacuum chamber at a location circumferentially spaced from said valve location.

11. A system as recited in claim 1, wherein a cable is utilized to support said system on the surface to be cleaned.

12. A system as recited in claim 11, wherein said cable is provided with a main drive motor and a supplemental drive motor, said supplemental drive motor and said main drive motor being selectively actuated.

13. A system as recited in claim 12, wherein said supplemental drive motor is actuated by a shiftable yoke to selectively engage the supplemental drive motor when said main drive motor is disconnected.

14. A system for cleaning a surface comprising:

a rotating fluid jet system provided by a plurality of nozzles rotating about a central axis;

an inner wall surrounding said rotating fluid jet system and an outer wall spaced from said inner wall;

a source of vacuum creating a vacuum in a chamber between said inner and outer walls;

a supplemental fluid flow into said vacuum chamber at an area associated with a first circumferential location, and said vacuum chamber being defined to have a smaller cross-sectional area in a plane defined along a radial direction relative to said central axis associated with said first circumferential location, and said vacuum chamber having a greater cross-sectional area at locations circumferentially spaced from said first location.

15. A system as recited in claim 14, wherein said supplemental fluid flow passes through said outer wall through a spring biased valve.

16. A system as recited in claim 15, wherein said cross-sectional area of said vacuum chamber is defined by a slanted end wall, said end wall being spaced more towards the surface to be cleaned at a location associated with said first circumferential location, and being slanted away from said first location in both circumferential directions.

17. A system for cleaning a planar surface comprising:

a central rotating fluid jet system for supplying a high pressure fluid against the surface to be cleaned;

a vacuum chamber associated with a vacuum source, said central rotating fluid jet system and said vacuum chamber both being mounted on a central body portion;

a base portion provided with a drive for driving said base portion along a surface to be cleaned, said central rotating fluid jet system being mounted for relative rotation on said base portion, and for movement with said base portion;

a first wall surrounding said central rotating jet system and a second wall spaced radially outwardly of said first wall, said vacuum chamber defined between said first and second walls; and said vacuum chamber being defined by a slanted wall which modifies a cross-sectional area defined in a plane extending radially relative to an axis of rotation of said rotating fluid jet system of said vacuum chamber between spaced circumferential locations.

18. A system for cleaning a planar surface comprising:

a central rotating fluid jet system for supplying a high pressure fluid against the surface to be cleaned;

a vacuum chamber associated with a vacuum source, said central rotating fluid jet system and said vacuum chamber both being mounted on a central body portion;

a base portion provided with a drive for driving said base portion along a surface to be cleaned, said central rotating fluid jet system being mounted for relative rotation on said base portion, and for movement with said base portion; and a cable being utilized to support said system on the surface to be cleaned.

* * * * *